US005545272A

United States Patent [19]

Poole et al.

[11] Patent Number: 5,545,272

[45] Date of Patent: Aug. 13, 1996

[54] THERMALLY STABLE GAS GENERATING COMPOSITION

[75] Inventors: Donald R. Poole, South Colby; Gary F. Holland, Snohomish; Nicholas A. Wolf, Renton; Michael A. Wilson, Bothell, all of Wash.

[73] Assignee: Olin Corporation, Redmond, Wash.

[21] Appl. No.: 517,564

[22] Filed: Aug. 21, 1995

Related U.S. Application Data

[63] Continuation of Ser. No. 398,020, Mar. 3, 1995, abandoned.

[51] Int. Cl.[6] ..... C06B 31/56

[52] U.S. Cl. ..... 149/48; 149/78

[58] Field of Search ..... 149/48, 78, 109.6

[56] References Cited

U.S. PATENT DOCUMENTS 3,912,562 10/1975 Garner ..... 149/41

5,098,683 3/1992 Mehrotra et al. ..... 423/266

5,125,684 6/1992 Cartwright ..... 280/736

FOREIGN PATENT DOCUMENTS

WO95/04710 2/1995 WIPO .

*Primary Examiner*—Donald P. Walsh

*Assistant Examiner*—Anthony R. Chi

*Attorney, Agent, or Firm*—Gregory S. Rosenblatt

[57] ABSTRACT

There is provided a gas generating composition consisting essentially of a mixture of nitroguanidine and phase stabilized ammonium nitrate. When the ammonium nitrate is phase stabilized with from about 7% to about 20%, by weight, of a potassium salt, the mixture is structurally and volumetrically stable over typical automotive operating temperatures and has a melting temperature in excess of 100° C. The mixture generates large volumes of nitrogen and carbon dioxide when ignited with minimal generation of solids or toxic gases and is particularly useful as an inflating medium for automobile airbags.

14 Claims, No Drawings

THERMALLY STABLE GAS GENERATING COMPOSITION

This application is a continuation of application Ser. No. 08/398,020, filed Mar. 3, 1995, now abandoned which is incorporated herein by reference in its entirety.

BACKGROUND OF THE INVENTION

1. Field of the Invention

This invention relates to chemical compositions for generating large volumes of gas. More particularly, a mixture of nitroguanidine, ammonium nitrate and potassium nitrate is ignited and the gaseous combustion products used to inflate an automotive airbag.

2. Description of the Prior Art

Airbags, as a component of a passive automobile restraint system, are installed in the steering column and passenger side dashboard of passenger automobiles. The airbags inflate in a collision and, by restraining the passengers, minimize injury.

Typically, sensors mounted in the automobile detect a collision and send an electric signal igniting a chemical mixture that generates a large quantity of gas during deflagration. This gas is used to deploy the airbag.

As disclosed in U.S. Pat. No. 3,797,854 to Poole et al, which is incorporated by reference in its entirety herein, one common chemical mixture contains an azide, such as sodium azide, and an inorganic oxidizer, such as potassium perchlorate.

Sodium azide is difficult to handle safely and it is toxic. Assembly of the airbags must be done in a controlled environment and disposal of undeployed airbag cylinders is difficult.

The search for a replacement for an azide/inorganic oxidizer composition to inflate airbags has lead to the identification of five targets for the ideal chemical mixture.

(1) The chemical mixture should generate a large volume of benign gases with minimal generation of noxious gases such as carbon monoxide (CO) and nitrogen oxides ($NO_x$). One problem with azide based compositions is a low gas output, typically less than 1.5 moles of gas per 100 grams of the mixture.

(2) The chemical mixture must be thermally stable at temperatures in excess of 100° C. Automobiles may remain in service for many years and are subject to temperature extremes. The gas generating composition must have a working temperature in the range of from about −40° C. to about 100° C. The chemical compounds when heated to a temperature of 100° C. should not exhibit a significant net weight loss nor any evidence of physical change.

(3) The generation of solids is detrimental. The solids do not assist in the inflation of the airbag and must be filtered from the gas stream.

(4) The flame temperature or the combustion temperature of the chemical mixture, should be as low as possible. At lower temperatures, decreased levels of CO are generated due to formation of more carbon dioxide. Lower levels of $NO_x$ are generated because of more favorable equilibrium and kinetic considerations.

(5) The chemical mixture should be deflagrating as opposed to detonating. On ignition, the mixture should burn rapidly rather than explode.

One substitute for azide/inorganic oxidizer gas generating mixtures is a mixture of 5-aminotetrazole and strontium nitrate plus other additives as disclosed in U.S. Pat. No. 5,035,757 to Poole. These compositions typically have greater gas outputs than azide generating gas compositions and exhibit good thermal stability. However, the flame temperature exceeds 2500° K. resulting in excessively high level of CO and $NO_x$. Furthermore, although toxicity concerns are considerably reduced, as compared to azide propellants,gas output levels are limited by the high levels of solids in the exhaust composition.

As disclosed in copending and commonly assigned U.S. patent application Ser. No. 08/214,509 entitled "Gas Generating Propellant" by Henry, III et al that was filed on Mar. 18, 1994 and is incorporated by reference in its entirety, one category of gas evolving compounds includes a guanidine salt. Gas is generated by igniting a mixture consisting essentially of (by weight) 55%–75% guanidine nitrate, 25%–45% of an oxidizer selected from the group consisting of potassium perchlorate and ammonium perchlorate, 0.5%–5% of a flow enhancer and up to 5% of a binder.

The mixture disclosed in Henry et al. is for use an augmented airbag system. In augmented systems, the main use of the propellant is to heat a pressurized gas which is the primary gas source for inflation of the bag. The amount of gas produced by the propellant is a small fraction of the total gas required to inflate the airbag.

Ammonium nitrate (AN) based propellants offer the capability of meeting many of the targets for airbag inflation. Many AN-based propellants and explosives are known.

German Patentschrift 851,919, published October 1952 by Imperial Chemicals Industries Limited, discloses a gas generating compound containing ammonium nitrate, sodium nitrate, guanidine nitrate and nitroguanidine.

U.S. Pat. No. 4,421,578 by Voreck, Jr., discloses an explosive mixture containing ammonium nitrate, potassium nitrate, nitroguanidine and ethylenediamine dinitrate. This composition was developed for explosive applications with an intent to replace TNT (2,4,6-trinitrotoluene). The eutectic formed when ammonium nitrate, ethylene diamine dinitrate and guanidine nitrate are mixed in the disclosed proportion has a melting temperature below 100° C. Propellant mixtures with such a low melting point are not suitable for applications such as automobile airbag inflators where temperature stability in excess of 107° C. is frequently required.

Both ammonium nitrate and phase stabilized ammonium nitrate (PSAN) are thermally stable for extended periods of time at a temperature of 107° C. However, mixtures of AN and PSAN with a wide variety of materials ranging from polymeric binders to high energy fuels to common burn rate catalysts do not exhibit acceptable thermal stability as measured by weight loss and/or melting. Table 1 illustrates this phenomenon.

TABLE 1

| Oxidizer | Fuel | Additive | Weight Loss* |
|---|---|---|---|
| PSAN | None | None | ≦0.1% |
| PSAN | Hydroxy-terminated polybutadiene (HTPB)/IPDI | Milori blue, carbon black | 0.5% |
| PSAN | None | Milori blue | 4% |
| PSAN | None | Carbon black | 354 |
| PSAN | Carboxy-terminated polycarbonate-IPDI | Milori blue | 64 |

TABLE 1-continued

| Oxidizer | Fuel | Additive | Weight Loss* |
|---|---|---|---|
| PSAN | 5-amino-tetrazole | None | Melts with loss of $NH_3$ |
| PSAN | ethylene diamine dinitrate, nitroguanidine | potassium nitrate | Melts < 100° C. ★★ |

Table 1 notes:
*After thermal aging 400 hours at 107° C.
IPDI = isophorone di-isocyanate
Milori blue = an iron blue pigment.
★★ = composition of U.S. Pat. No. 4,421,578.

A problem with the use of pure ammonium nitrate is that the compound undergoes a series of structural phase transformations over the typical operating range of automobile airbag inflators. In pure AN, structural phase transitions are observed at −18° C., 32.3° C., 84.2° C. and 125.2° C. The phase transition at 32.3° C. is particularly problematic during temperature cycling because of a large change in the associated volume, on the order of 3.7% by volume. Generally, any volumetric change is detrimental and it is desired to limit any volumetric change as much as possible.

Phase stabilization of ammonium nitrate by the inclusion of potassium salts, such as potassium nitrate and potassium perchlorate is known. PSAN containing 15% by weight potassium nitrate will successfully avoid the problematic phase changes and volume changes associated with pure AN.

There remains therefore a need for an azide-free chemical composition useful to inflate automotive airbags that generates large volumes of benign gases, has thermal stability at temperatures in excess of 100° C. generates a low volume of solids, has a low flame temperature and is not explosive.

SUMMARY OF THE INVENTION

Accordingly, it is an object of the invention to provide a chemical mixture that generates a volume of gas to inflate an automobile airbag. Other objects of the invention include that the chemical mixture is azide free, that the gas generated has a minimum amount of solids and noxious gases and that the gas is physically and chemically stable through the range of temperatures required for automobile airbags.

One unique feature of the invention is that the chemical mixture resists thermal decomposition at temperatures in excess of 100° C. Mixtures of many chemical compounds with ammonium nitrate are not stable at temperatures in excess of 100° C., and these mixtures are not suitable for use in automobile airbags. Another feature of this invention is that the chemical mixture includes nitroguanidine and ammonium nitrate in a stoichiometric ratio that minimizes the generation of noxious gases such as CO and $NO_x$. Still another feature of the invention is that phase stabilized ammonium nitrate prevents the physical degradation of the propellant during thermal cycling.

It is a feature of the invention that the chemical mixture includes a mixture of nitroguanidine and ammonium nitrate in a ratio effective to produce deflagration rather than detonation on ignition. It is another feature of the invention that phase stabilized ammonium nitrate is used to prevent physical breakdown of the propellant on thermal cycling. In one embodiment, potassium nitrate is added to provide thermal stability up to 110° C. In addition, it is a feature of the invention that the flame temperature is less than 2450° K.

It is an advantage of the invention that by using a mixture of nitroguanidine, ammonium nitrate and potassium nitrate in a specified ratio, a nonexplosive chemical mixture generates a large volume of benign gases on ignition. The flame temperature is below 2450° K., minimizing generation of noxious gases such as CO and $NO_x$.

In accordance with the invention, there is provided a gas generating composition consisting essentially of from about 35% to about 55% by weight nitroguanidine and from about 45% to about 65% by weight phase stabilized ammonium nitrate. The composition has a melting temperature in excess of 100° C. and deflagrates when ignited.

The above stated objects, features and advantages will become more apparent from the specification and drawing that follows.

DETAILED DESCRIPTION

The combination of phase stabilized ammonium nitrate and nitroguanidine produces a series of chemical compositions that, when ignited, generate high levels of a gas that has a low content of noxious constituents such as CO and $NO_x$. The gas is characterized by a low level of residual solids and ballistics suitable for use as an inflator of automobile airbag units.

An unexpected benefit of these chemical compositions is thermal stability. Aging of the chemical composition at temperatures in excess of 100° C. does not cause a significant weight loss or a change in ballistic properties. This thermal stability in the ammonium nitrate—nitroguanidine combination was unexpected because of the typically high reactivity observed between ammonium nitrate and other materials at elevated temperatures.

Ammonium nitrate based propellants are particularly useful in automobile airbag inflators because of the high gas outputs and the low levels of residual solids resulting from their combustion. The only solids produced by phase stabilized ammonium nitrate are derived from the additives used to accomplish the phase stabilization.

The chemical compositions of the invention include nitroguanidine ($CH_4N_4O_2$), a highly energetic fuel having a large negative oxygen balance (−30.7%). Nitroguanidine can be combined in a stoichiometric ratio with phase stabilized ammonium nitrate to produce chemical mixtures that are relatively insensitive to impact (≧180 kg/cm), friction (≧360N) and electrostatic discharge (≧3 J).

The stoichiometric ratio of oxidizer to fuel is adjusted to provide a level of free hydrogen in the exhaust gases of between zero and about 3% by volume. More preferably, the level of free hydrogen is between zero and about 0.5% by volume. The stoichiometric ratio of oxidizer to fuel is also adjusted to provide a level of free oxygen in the exhaust gases of from zero to about 4% by volume. More preferably, the level of free oxygen is from zero to about 0.5% by volume.

Potassium salts, such as potassium nitrate, potassium perchlorate, potassium dichromate, potassium oxalate and mixtures thereof, are the preferred phase stabilizers with potassium nitrate being most preferred. Other compounds and modifiers that are effective to phase stabilize ammonium nitrate are also suitable. The stabilizing agent is present in an amount effective to minimize a volumetric and structural change associated with the Phase IV⇆Phase III structural phase transition that is inherent to pure ammonium nitrate.

The preferred phase stabilized ammonium nitrate contains from about 5% to about 25% by weight potassium nitrate and more preferably from about 10% to about 15% by weight potassium nitrate.

To maintain the desired chemical stability, effluent characteristics and ballistic properties of the chemical mix, the ratio of nitroguanidine to PSAN is, by weight, from about 1:1 to about 1:2 and more preferably from about 1:1.1 to about 1:1.5.

The gas generating composition of the invention generally consists essentially of, by weight, from about 35% to about 55% nitroguanidine and from about 45% to about 65% phase stabilized ammonium nitrate. Additions such as flow enhancers or molding facilitators may be present provided the additions do not detract from the deflagratory characteristic of the composition.

In a preferred embodiment, the gas generating composition consists essentially of, by weight, from about 40% to about 46% nitroguanidine and from about 54% to about 60% phase stabilized ammonium nitrate.

In one most preferred embodiment, the composition consists essentially of, by weight, from about 43% to about 44% nitroguanidine and from about 56% to about 57% potassium perchlorate stabilized ammonium nitrate.

In a second most preferred embodiment, the composition consists essentially of, by weight, from about 42% to about 44% nitroguanidine and from about 56% to about 58% potassium nitrate stabilized ammonium nitrate.

A mixture of the phase stabilized ammonium nitrate and nitroguanidine powders of the desired chemical composition may be ground, commingled and compression molded into a tablet of a desired size using standard compression molding techniques. Typically, prior to burn rate measurement, the powders are pressed into pellets having a diameter of about 12.7 mm (0.5 inch), a length of about 12.7 mm and a mass of approximately 3 grams. The pellets are coated with a flame inhibitor, such as an epoxy/titanium dioxide mixture to prevent burning along the sides of the pellet.

The advantages of the chemical compositions of the invention will become more apparent from the examples that follow.

EXAMPLES

Example 1

A quantity of 10% potassium nitrate in a phase stabilized ammonium nitrate mixture (10% KN-PSAN) was prepared by co-precipitating ammonium nitrate with 10 weight percent potassium nitrate from an aqueous solution. After drying, the solid was ball milled to reduce particle size producing a fine granular material.

A mixture of 16.40 grams nitroguanidine and 23.60 grams of the 10% KN-PSAN was prepared by ball milling the powders to mix and reduce particle size. Pellets were formed by compression molding the powder to form grains of approximately 12.7 mm (0.5 inch) diameter by 12.7 mm length with a mass of 3 grams. The pellets were compression molded at approximately 296 MPa (43,000 psi) and then coated with an epoxy/titanium dioxide flame inhibitor.

The theoretical combustion temperature of the mixture is 2409° C. The burning rate of the pellets was measured and found to be 8.6 mm (0.34 inch) per second at 6.9 MPa (1000 psi) with a pressure exponent of 0.47. The primary gas produced by combustion was, by volume, 53% water, 37% nitrogen, 9% carbon dioxide and 0.3% oxygen. The primary solid product produced by combustion was potassium carbonate.

Closed bomb aging of pellets at 107° C. resulted in an average weight loss of 0.21 weight percent after 400 hours aging. Drop weight test on this material indicates an impact sensitivity in excess of 180 kg·cm.

Example 2

A mixture of nitroguanidine and 15% KN-PSAN was prepared according to the process of Example 1 and pellets formed by compression molding. The composition, by weight, of this mixture was 42.3% nitroguanidine and 57.7% PSAN.

The theoretical combustion temperature of this mixture is 2399° C. The primary gas produced by combustion was, by volume, 52% water, 38% nitrogen, 9% carbon dioxide and 0.2% oxygen. The primary solid product produced by combustion was potassium carbonate.

The linear burn rate of these pellets was measured at 6.9 MPa (1000 psi) and found to be 8.1 mm (0.32 inch) per second. Differential scanning calorimetry (DSC) measurements revealed no endotherms characteristic of ammonium nitrate phase transitions over the temperature range of 0° C.–115° C.; confirming incorporation of potassium nitrate into ammonium nitrate to form PSAN. Endotherms corresponding to the ammonium nitrate Phase III-to-II and the Phase II-to-I structural phase transitions occurred at approximately 120° C. and 130° C., respectively. The onset of AN melting occurred at approximately 165° C. and the onset of an exotherm was approximately 245° C.

Example 3

A quantity of PSAN consisting of 13.7%, by weight, potassium perchlorate (KP) and 86.3% ammonium nitrate was prepared by co-precipitating the salts from an aqueous solution followed by drying. The solid was then ball milled to reduce particle size.

A mixture consisting of 43.6% nitroguanidine and 56.4%, by weight, KP-PSAN was prepared by dry blending using a ball mill with pellets then formed by compression molding.

Burn rate measurements at 6.9 MPa (1000 psi) indicated a burn rate of 8.6 mm (0.34 inch) per second and a pressure exponent of 0.67. The combustion temperature is theoretically 2571° K. The primary gas produced by combustion contains (by volume) 52% water, 37% nitrogen, 11% carbon dioxide and 0.1% hydrogen. The solid product produced by combustion is potassium chloride. Weight loss measurements of propellant pellets at 100° C. indicated 0.1% weight loss after 400 hours and 0.2% weight loss after 1000 hours.

Example 4

A 1.5 kg batch of 41.8% nitroguanidine and 58.2% of 10% KN-PSAN was prepared by ball milling 627 grams of nitroguanidine with 873 grams of a 10% KN-PSAN mix (prepared according to Example 1). After drying, the mixture was granulated to improve mixing and material flow. The pellets were compression molded on a high speed tableting press and found to form pellets of acceptable quality.

The theoretical combustion temperature of this mixture is 2423° C. The primary gas produced by combustion, by volume, was 52% water, 37% nitrogen, 11% carbon dioxide and 0.1% hydrogen. The primary solid produced by combustion was potassium carbonate.

The pellets formed on the high speed tableting press were tested in a gas generator and found to inflate an airbag satisfactorily.

Cap sensitivity tests performed on the aforementioned pellets (4.78 mm diameter, 2.03 mm thick) pursuant to Department of Transportation procedures indicated a negative sensitivity to initiation with a No. 8 blasting cap.

It is apparent that there has been provided in accordance with this invention a gas evolving chemical mixture that fully satisfies the objects, features and advantages set forth hereinabove. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A gas generating composition consisting essentially of:

from about 35% to about 55% by weight nitroguanidine; and from about 45% to about 65% by weight phase stabilized ammonium nitrate, said gas generating composition having a melting point in excess of 100° C. and capable of deflagration when ignited.

2. The gas generating composition of claim 1 wherein said phase stabilized ammonium nitrate is a mixture of ammonium nitrate and a stabilizing agent, said stabilizing agent present in an amount effective to minimize the volume and structural change associated with the phase change observed at approximately 32° C. in pure ammonium nitrate.

3. The gas generating composition of claim 2 wherein said stabilizing agent represents from about 5% to about 25%, by weight, of said phase stabilized ammonium nitrate.

4. The gas generating composition of claim 3 wherein said stabilizing agent is a potassium containing salt selected from the group consisting of potassium nitrate, potassium perchlorate, potassium dichromate, potassium oxalate and mixtures thereof.

5. The gas generating composition of claim 4 wherein the ratio of phase stabilized ammonium nitrate to nitroguanidine is effective to produce a gas having a maximum of 4%, by volume oxygen on ignition.

6. The gas generating composition of claim 4 wherein the ratio of phase stabilized ammonium nitrate to nitroguanidine is effective to produce a gas having a maximum of 3%, by volume hydrogen on ignition.

7. The gas generating composition of claim 6 wherein the ratio of nitroguanidine to phase stabilized ammonium nitrate, by weight, from about 1:1 to about 1:2.

8. The gas generating composition of claim 7 wherein the ratio nitroguanidine to KN-PSAN is, by weight, from about 1:1.1 to about 1:1.5.

9. The gas generating composition of claim 7 consisting essentially of from about 40% to about 46% nitroguanidine and from about 54% to about 60% phase stabilized ammonium nitrate.

10. The gas generating composition of claim 9 wherein said stabilizing agent is potassium perchlorate.

11. The gas generating composition of claim 10 consisting essentially of, by weight, from about 43% to about 44% nitroguanidine and from about 56% to about 57% phase stabilized ammonium nitrate.

12. The gas generating composition of claim 9 wherein said stabilizing agent is potassium nitrate.

13. The gas generating composition of claim 12 consisting essentially of, by weight, from about 41% to about 43% nitroguanidine and from about 57% to about 59% phase stabilized ammonium nitrate.

14. The gas generating composition of claim 7 wherein said nitroguanidine and said phase stabilized ammonium nitrate are a mixture of powders compacted into a pellet.

* * * * *